United States Patent [19]

Moss

[11] 4,275,644

[45] Jun. 30, 1981

[54] DUAL FLAP CARTON ERECTING MACHINE

[75] Inventor: Edward L. Moss, Orlando, Fla.

[73] Assignee: Moss Machinery Manufacturers, Inc., Orlando, Fla.

[21] Appl. No.: 33,209

[22] Filed: Apr. 25, 1979

[51] Int. Cl.[3] ..... B31B 1/62; B31B 1/76

[52] U.S. Cl. ..... 493/316; 493/183

[58] Field of Search ..... 93/39 R, 39.1 R, 39.1 P, 93/49 R, 49 M

[56] References Cited

U.S. PATENT DOCUMENTS

| | | | |
|---|---|---|---|
| 3,763,750 | 10/1973 | Reichert | 93/49 R X |
| 4,160,406 | 7/1979 | Nowacki | 93/49 M X |

*Primary Examiner*—Robert D. Baldwin

*Attorney, Agent, or Firm*—Stein & Frijouf

[57] ABSTRACT

An apparatus is disclosed for erecting folded cartons having top and bottom flaps. The apparatus comprises a carton track with a carton magazine disposed at one end thereof. First track movement means moves a folded carton on the track from the carton magazine to a first position. A top flap folder folds the top flaps of the carton to be substantially parallel to the sides of the carton. A second track movement means intermittently moves the cartons from the first station to the second end of the track. A carton erector is disposed at a position on the second track for erecting the folded carton. A bottom flap folding means is disposed at a third position on the track for folding the bottom flaps of the carton. A sealer is disposed at a fourth position on the track for sealing the bottom flaps of the erected rigid structure.

13 Claims, 18 Drawing Figures

DUAL FLAP CARTON ERECTING MACHINE

BACKGROUND OF THE INVENTION

1. Field of the Invention

This invention relates to containers, and more particularly to machines for assembling and erecting paper or cardboard cartons.

2. Description of the Prior Art

Various apparatuses have been developed in the art for aiding the packaging or containerization of manufactured items or the like. In many instances, manufacturing companies purchase cartons in the folded or unassembled condition. Generally, folded cartons are precut with four lateral sides and a top and/or a bottom composed of two major flaps and two minor flaps. The folded carton is shipped in the folded position wherein all lateral sides of the carton are substantially parallel to one another. Accordingly, the top flaps of the carton are first folded back and the carton is then erected such that two of the parallel sides are perpendicular to the remaining two parallel sides. The two minor or smaller flaps are folded and adhesive is applied to either the minor or the major flaps. The major or large flaps are subsequently folded into contact with the minor flaps to form the top or the bottom of the carton. The major and minor flaps are then pressed against one anotner while the adhesive sets to complete the bottom of the folded carton with the top flap folded back parallel to the sides of the carton.

The manual erection, folding and sealing of cartons is a time consuming and expensive operation. Accordingly the prior art has attempted to develop simple, inexpensive and reliable carton erecting machines which may be purchased by a manufacturer desiring to ship a product in cartons. In general, such a carton erecting machine is a non-productive capital investment to the manufacturer since the machine is not producing an end product. The machine is only used for assembling the folded cartons to ship the manufactured or end products therein. Although the use of a carton erecting machine does save valuable man-hours, the machine does not increase production in terms of the number of manufacturered units produced. Accordingly, it is understandable that a manufacturer is reluctant to invest a large sum for an automated carton erecting machine. In addition, it is extremely disturbing for the manufacturer to purchase a sophisticated carton erecting machine to find that the machine frequently requires service to maintain operation of the machine.

Various types of carton erecting machines have been used by the prior art. Among the more reliable machines were the L-shaped machines having a first and a second carton track. A carton magazine was located at one end of the first carton track whereas a carton erector was located at the intersection of the first and second carton tracks. The second carton track was used for folding the major and minor carton flaps and sealing the flaps together. Although the L-shaped machines of the prior art had the advantage of a positive carton stop at the intersection of the first and second carton tracks, the machine required a complex mechanical linkage for moving the carton along the first and second tracks. Some in the prior art have incorporated a reciprocal movement means for moving the cartons along one of the tracks which reciprocal movement was coupled through a clutch mechanism to move cartons along the other of the tracks. Unfortunately, the clutch mechanism had a limited life, making the entire machine unreliable and costly to operate and maintain. It is not surprising that these machines were not widely accepted in the art.

Therefore it is an object of this invention to provide an apparatus which overcomes the aforementioned inadequacies of the prior art devices and to provide an improvement which is a significant contribution to the advancement of the packaging art.

Another object of this invention is to provide an apparatus for erecting folded cartons comprising first means for driving cartons along the first track portion which is synchronized with second means for driving cartons along a second track portion.

Another object of this invention is to provide an apparatus for erecting folded cartons wherein the first means is connected to said second means for generating a longitudinal movement along the first track portion to grasp and move a carton from a carton magazine along the first track portion.

Another object of this invention is to provide an apparatus for erecting folded cartons wherein the second means includes a first and a second rotatable sprocket spaced relative to one another with a chain interconnecting the first and second rotatable sprockets. A driving pin extends from the chain which pin is received between plural fingers for generating a reciprocal movement from the projection upon rotation of the sprockets.

Another object of this invention is to provide an apparatus for erecting folded cartons wherein a first stage folds the top major and minor flaps of the carton prior to erection of the carton.

Another object of this invention is to provide an apparatus for erecting folded cartons wherein the second driving means provides engagement with both the bottom and the top of the carton through the use of a C-shaped drive mechanism.

Another object of this invention is to provide an apparatus for erecting folded cartons having a carton erector and a bottom minor flap tucker arm each of which is adjustably mounted relative to the machine by mounting plates. The adjusted mounting plates enable simplified and custom adjustment within the machine or interchange of components with other machines of similar nature.

Another object of this invention is to provide an apparatus for erecting folded cartons wherein the apparatus may be quickly repaired in the remote possibility of a malfunction.

Another object of this invention is to provide an apparatus for erecting folded cartons wherein the individual stages of this machine may be used as individual stages for similar erecting machines specifically designed for folding or erecting different type cartons.

Another object of this invention is to provide an apparatus for erecting folded cartons which has been greatly simplified over the prior art machines thereby increasing the reliability and reducing the manufacturing cost thereof.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings and explained in the detailed discussion. For the purpose of summarizing the invention, the invention may be incorporated into an apparatus for erecting folded cartons having top and bottom flaps. The apparatus comprises a carton track having a first and a second end. Carton magazine means is disposed at the first end of the track. First track movement means moves a folded carton in a stack within the carton magazine to the first position. Second track movement means moves the carton from the first position to the second end of the track. A carton errector is disposed at a second position on the track for erecting the folded cartons into a semi-permanent structure. Thereafter, a bottom flap folding means is disposed at a third position on the track for folding the bottom flaps of the carton. A sealer is disposed at a fourth position on the track for sealing the bottom flaps of the erected carton into a rigid structure.

In a more specific embodiment of the invention, the first track movement means includes a pickup head for moving the carton along the track. Preferably, the pickup head is moved in accordance with the second track movement means. The second track movement means preferably includes a first and a second rotatable member spaced relative to one another. Each of the rotatable members may be in the form of a sprocket, a pulley or the like. A flexible means, such as a chain, belt or the like interconnects the first and second rotatable members for movement therewith. A driving portion such as a projection, extends from the flexible means defining a reciprocal movement upon rotation of the rotatable members. Preferably, parallel fingers receive the projection therebetween for generating reciprocal movement upon rotation of the rotatable members. The reciprocal movement of the plural parallel fingers is preferably connected by a C-shaped member slidably mounted relative to the carton track for simultaneously engaging the top and bottom of the erected carton. The second track movement means may include carton engaging means for engaging the carton upon a forward movement of the track movement means and for disengaging the carton upon a rearward movement of the second track movement means.

In other forms of the invention, the erecting means includes a mounting plate having a plurality of slot apertures for positioning the carton erecting means relative to the apparatus. An air cylinder is secured to the mounting plate enabling adjustment of the carton erecting means relative to the apparatus. In a similar fashion, the bottom flap folding means comprises a tucker arm pivotably mounted relative to a mounting plate. An air cylinder is secured to the mounting plate for rotating the tucker arm. The tucker arm mounting plate is adjustably mounted relative to the apparatus enabling replacement or adjustment thereby. The sealer, which may be in the form of an air ram cylinder, seals the bottom flaps of the carton.

In still a further embodiment, the first track movement means includes a pickup head which is slidably mounted relative to the track along a horizontal plane. The pickup head engages the end of the carton and moves the carton from the first end of the first track to the first position. The pickup head is then lowered by action of gravity and returned to the first end of the first track to engage a subsequent carton.

The invention comprises both top and bottom flap folding means. The bottom flap folding means comprises a first and a second flap folder for folding the minor and major flaps of the carton. The top flap folder means comprises plural separator arms which are positionable between the top flaps of the carton. Means such as an air cylinder are provided for separating the plural separator arms to separate the flaps thereby folding the top flaps parallel to the sides of the container.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present inention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIGS. 2A–2E illustrate the various stages of folding a carton having top and bottom flaps;

Similar reference characters refer to similar parts throughout the several views of the drawings.

DETAILED DESCRIPTION OF THE DRAWINGS

Figure 1:
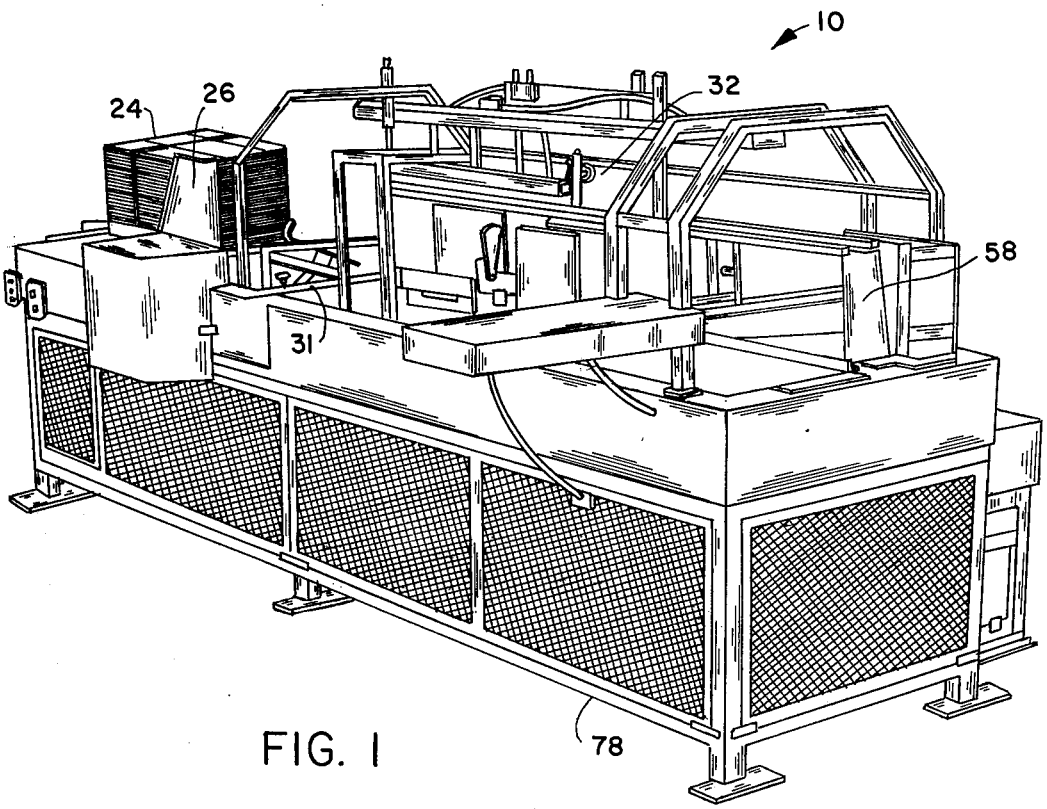
FIG. 1 is a perspective view showing the apparatus with cartons in various stages of assembly.
Figure 2A:
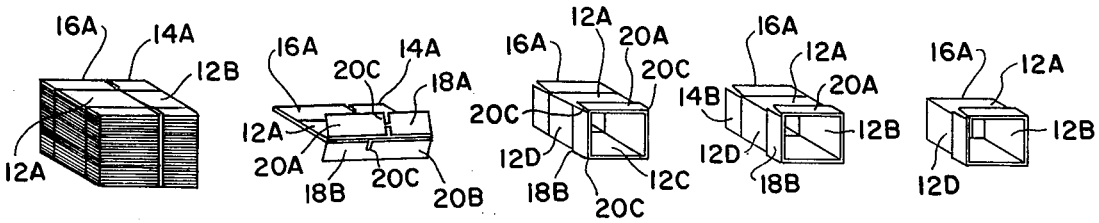

FIG. 1 is an isometric view of an apparatus 10 for erecting folded cartons 12. The cartons 12 are shown in FIGS. A–E in the various steps of assembly. The folded carton in FIG. 2A comprises four lateral sides 12A–12D, two minor bottom minor flaps 14A and 14B and two major bottom flaps 16A and 16B. The carton 12 also comprises two top minor flaps 18A and 18B and two top major flaps 20A and 20B. The top minor flaps 18A and 18B are connected to the top major flaps 20A and 20B by two tabs 20C. The tabs 20C enable the carton to be erected with the top flaps held in an open position substantially parallel to the carton lateral sides 12A–12D as shown in FIG. 2C. This process is accomplished by first folding the top major and top minor flaps back as shown in FIG. 2B and erecting the carton as shown in FIG. 2C. The bottom flaps are then folded and sealed as shown in FIGS. 2D and 2E.

Figure 3:
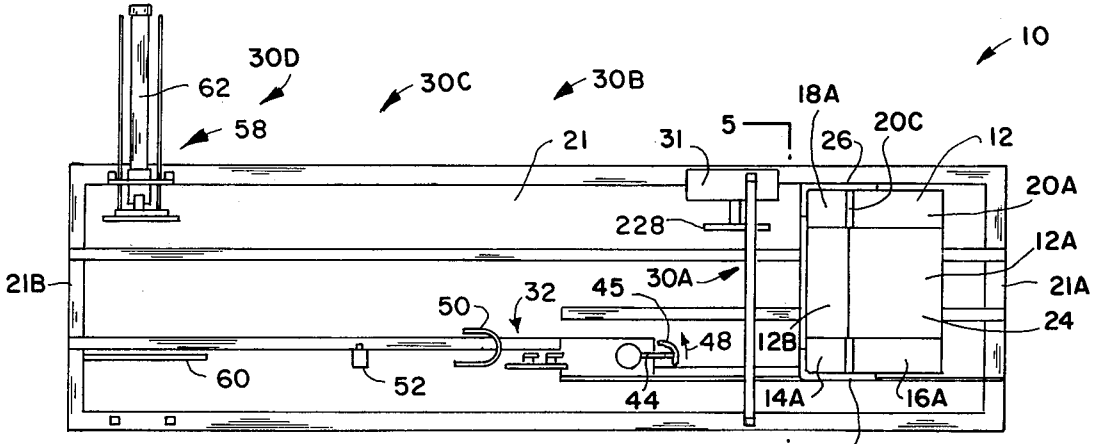
FIG. 3 is a simplified plan view of the apparatus.
Figure 4:
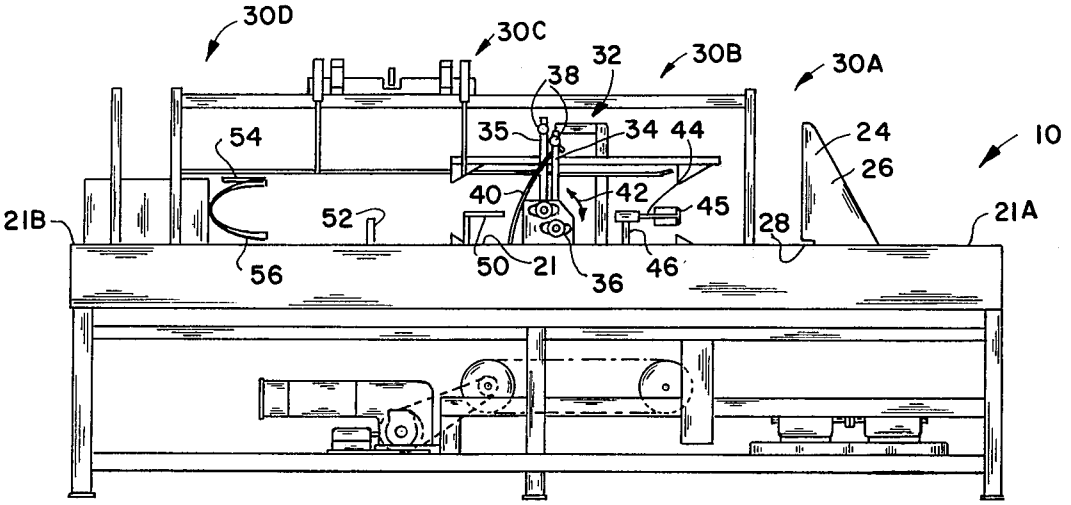
FIG. 4 is a simplified side elevational view of the apparatus.

The apparatus 10 which is more fully shown in FIGS. 3 and 4 comprises a carton track 21 having a first end 21A and a second end 21B. A carton magazine 24 is located in proximity to the first end 21A of the carton track 21. The carton magazine 24 comprises plural upstanding corner guides 26 each of which has a bottom slot 28 shown in FIG. 4 enabling only a single bottom carton to move along track 21 from the first end 21A to the second end 21B. The bottom carton from the stack of cartons in magazine 24 is moved by first track movement means 71 shown more fully in FIG. 6 to a first position 30 along the carton track 21.

Figure 5:
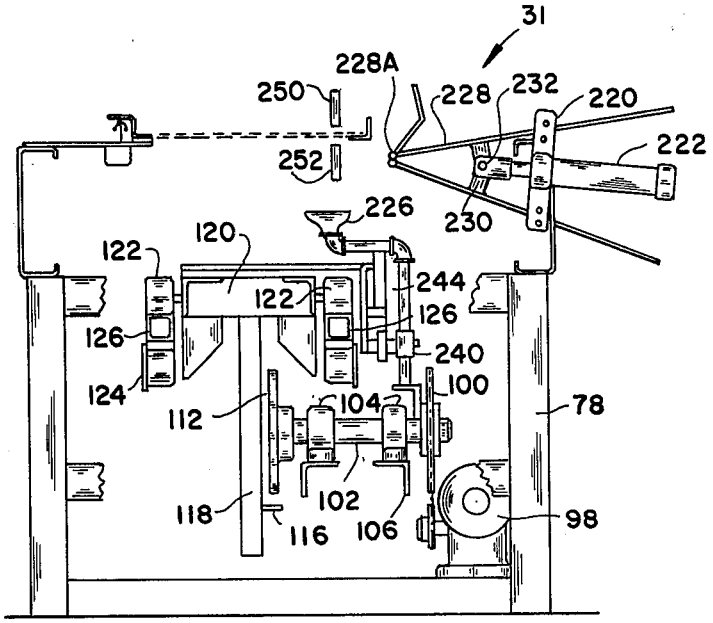
FIG. 5 is an enlarged sectional view along line 5—5 in FIG. 3.
Figure 13:
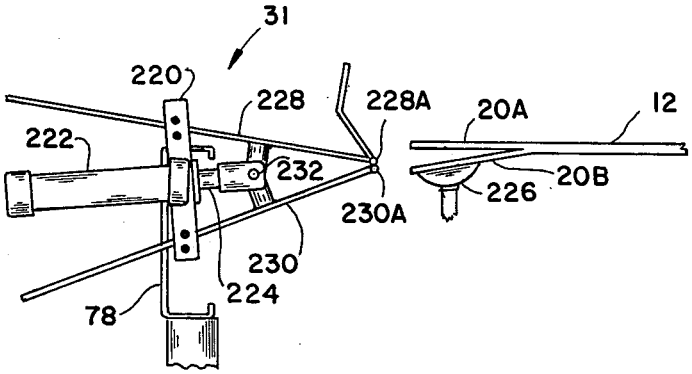
FIG. 13 is a side view of a top flap folder in the deactivated position.
Figure 14:
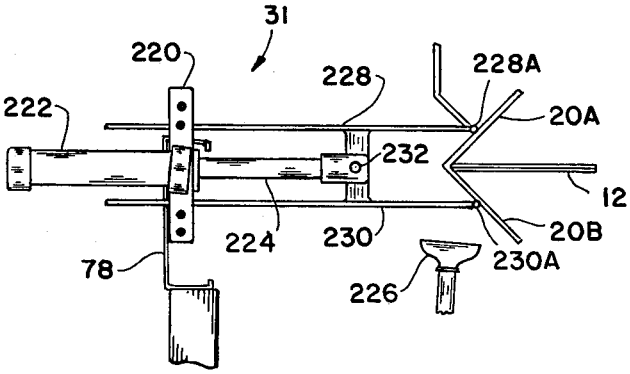
FIG. 14 is a side elevational view of the flap folder in the activated position.

A top flap folder means 31 shown more fully in FIGS. 5, 13 and 14 fold the top flaps of the carton as shown in FIG. 2B. The top folded carton is then moved to a second position 30B along the carton track 21 to a carton erector stage 32. The carton erecting means 32 shown in detail in FIGS. 10 and 11 comprises arms 34 and 35 pivotably mounted on a support 36 and having a vacuum cup 38 mounted on the terminal end of arm 34. A vacuum line 40 connects vacuum cup 38 to a vacuum source (not shown). The carton erector stage 32 erects the carton 12 by first rotating arm 34 downwardly in the direction shown by arrow 42 until the vacuum cup 38 contacts major flap 16A. Vacuum is applied through vacuum line 40 to grasp major flap 16A. Rotation of the arm 34 is an upward direction as shown by arrow 42 erects the carton 12 as shown in FIG. 2C. A tucker arm 44 shown in greater detail in FIG. 9, comprises a shoe 45 pivotably mounted on shaft 46 to fold minor flap 14B upon rotation of shaft 46 in a direction shown by arrow 48 in FIG. 3. Upon folding the minor flap 14B, shaft 46 rotates ninety degrees from the position shown in FIG. 3 in a direction opposite to the direction indicated by arrow 48. The partially erected carton 12 is then moved along the carton track 21 as will be hereinafter described.

Figure 12:
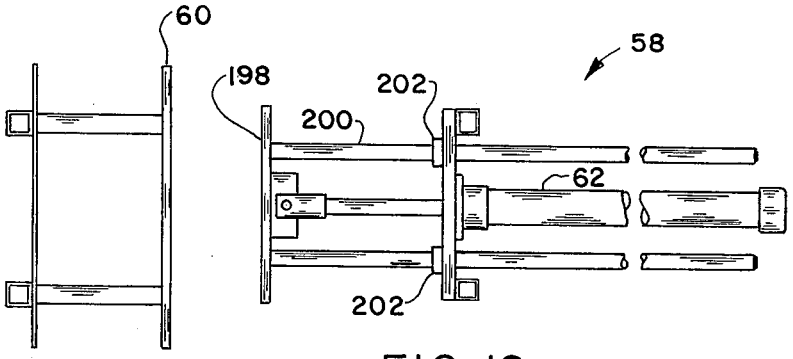
FIG. 12 is a plan view of ram stage of the apparatus.

A minor flap plow 50 folds minor flap 14A upon movement of the carton 12 along the second track 21. An adhesive station 52 comprises a compressed air adhesive spray gun activated by photoelectric or mechanical means for spraying an adhesive on the minor flaps 14A and 14B. Major plow surfaces 54 and 56 respectively fold major flaps 16A and 16B upon continued movement of the carton 12 along second track 21. A ram station 58 shown more clearly in FIG. 12, comprises a plate 60 and a hydraulic pneumatic or mechanical ram 62 to press the major flaps 16 into contact with the minor flaps 14 for sealing the erected carton 12 into a rigid structure. The completed carton 12 is forced off of the second end 21B of the carton track 21 by the next subsequent carton moving through the assembly process.

In FIGS. 5–8, the first means 71 comprises an arm 74 secured to a slidable support 125 having a pivotable carton pusher 76 for feeding the bottom carton in magazine 24. The carton pusher 76 is biased by a spring (not shown) into the full positon but being retractable to the phantom positon upon moving to the right in FIG. 6. The second means 72 comprises a motor 98 driving a slip clutch 100 for rotating a shaft 102 journalled by bearings 104 secured to supports 106. A first and second rotatable member 111 and 112 shown as sprockets are interconnected by a chain 114 with a projection 116 extending from chain 114. Sprocket 112 is secured to shaft 110 joined by bearings 108.

Plural parallel fingers 118 are secured to a slidable support frame 120 having rotatable wheels 122 and lower rotatable wheels 124 respectively contacting the upper and lower sides of a support beam 126. Rotation of the sprockets 111 and 112 causes a reciprocal movement of slidable support 120 relative to support means 126. It should be appreciated in FIGS. 5 and 7 that plural support beams 126 are utilized in combination with four upper wheels 122 and four lower wheels 124. A lower support guide 125 is adjustably mounted to the support frame 120 by telescopic sections 127, 128 and fasteners 129. The lower support guide 125 receives plural carton engaging means 130 and 132. An upper support guide 134 is suspended by a generally C-shaped vertical support 136 for positioning upper carton engaging means 140 and 142. The upper carton engaging means 140 and 142 are adjustably mounted by mounts 137 and 138 and telescoping sections 137A and 138A. It should be appreciated that carton engaging means 130, 132, 140 and 142 are adjustable along beams 125 and 134 to accommodate different size cartons. The carton engaging means 130, 132, 140 and 142 are respectively pivoted on pivots 130A, 132A, 140A and 142A.

The upper and lower carton engaging means 132 and 142 are shown in the retracted position whereas the upper and lower engaging means 130 and 140 are shown in the extended positions. The upper carton engaging means 140 and 142 are normally biased in the extended position by gravity. Movement of the upper beam 134 to the right in FIG. 6 causes ramp surfaces 140B and 142B to engage the upper portion of the carton to retract into the retracted position. The lower carton engaging means 130 and 132 are biased in the extended position by light tension springs 130C and 132C. Rearward movement of the beam 125 to the right in FIG. 6 enables the ramp surfaces 130B and 132B to strike the bottom portion of the carton to move into the retracted position. It should be appreciated that the simplicity of design incorporating the C-shaped vertical support 136 enables both the bottom and the top portion of the carton to be conveyed on the carton track 21 with a mininum of mechanical linkage. The first means 71 withdraws the carton from the carton magazine 24 upon movement of the track movement means 72. The top flaps are opened and the track movement means 72 then conveys the carton to the erector means 32.

Figure 8:
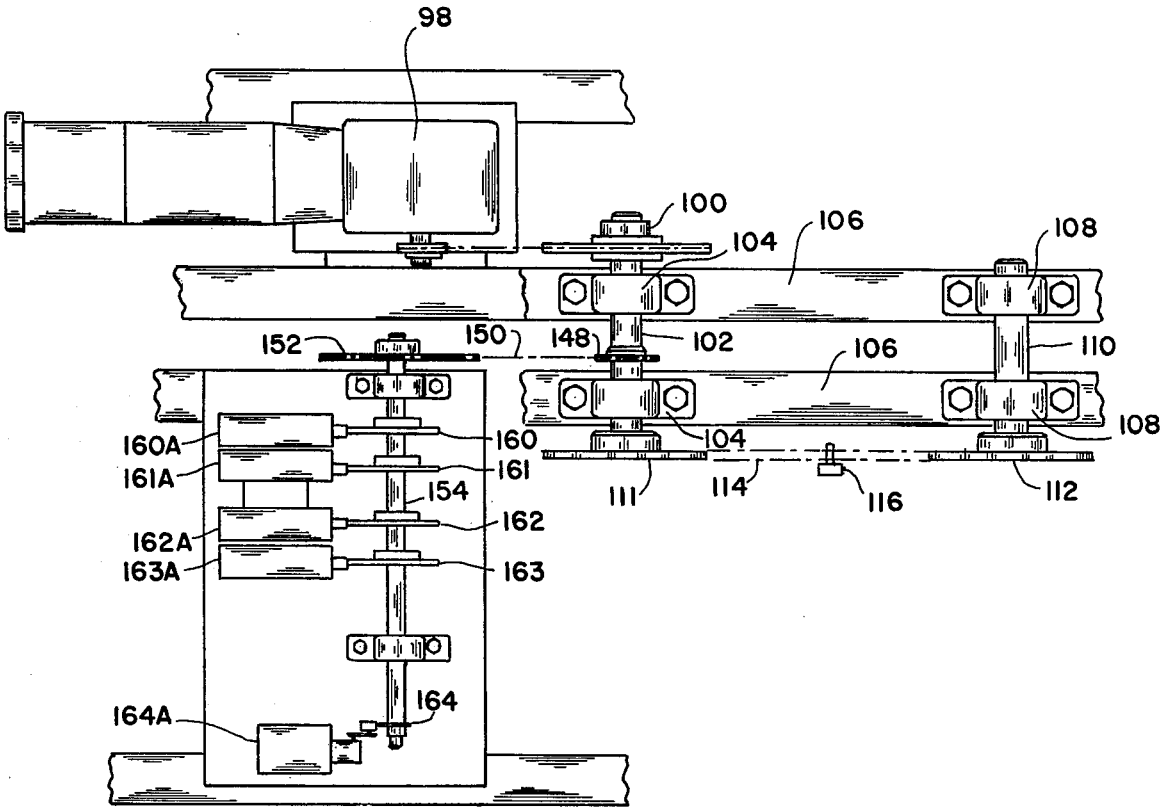
FIG. 8 is a plan view of a motor drive and conrol.

The rotatable shaft in 102 in FIG. 8 includes a sprocket 148 which drives a chain 150 connected to a sprocket 152 to rotate a shaft 154 having a plurality of cams 160–164 thereon. A plurality of switches 160A–164A provide the control to the various functions of the operation of the machine. Switch 160A controls the tucker arm assembly 44 whereas switch 161A controls the carton erecting means 32. Switch 163A contols the cylinder of compression ram 62. Limit switch 163A controls the top flap folder 31 whereas switch 164A is a limit switch for running a complete cycle.

Figure 9:
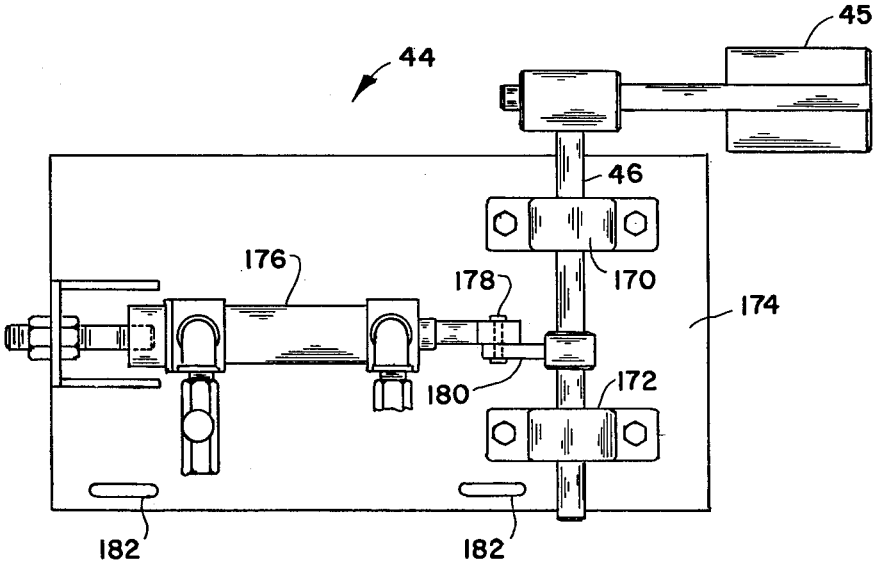
FIG. 9 is a side elevational view of a tucker arm utilized within the instant invention.

FIG. 9 is an enlarged view of the tucker arm assembly 44 comprising shoe 45 pivotably mounted on shaft 46. Shaft 46 is journalled by bearings 170 and 172 relative to a mounting plate 174. An air cylinder 176 is connected by a pivot 178 to an arm 180 extending from shaft 46. Activation of air cylinder 176 causes the rotation of shaft 46 enabling the shoe 45 to contact the bottom flaps of the carton. Mounting slots 182 enable the tucker arm assembly 44 to be adjusted or replaced from the apparatus.

Figure 10:
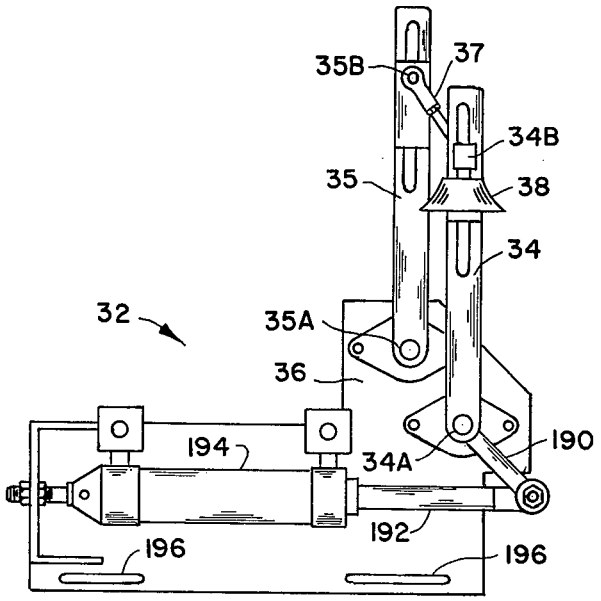
FIG. 10 is a side elevational view of a carton erector shown in the deactivated position.
Figure 11:
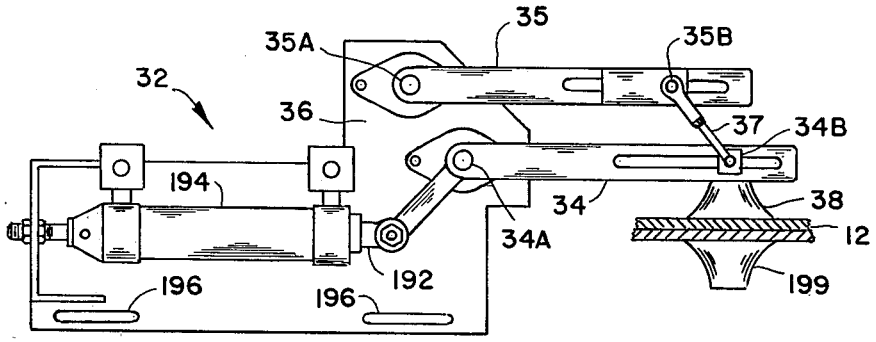
FIG. 11 is a side elevational view of the carton erector shown in the activated position.

FIGS. 10 and 11 illustrate the carton erector means 32 in the deactivated and activated positions respectively. The plural arms 34 and 35 rotatably mount the vacuum cup 38 relative to the support plate 36. The plural arms 34 and 35 include pivots 34A, 34B, 35A and 35B with a connecting link 37 completing a parallelogram. Accordingly, the bottom surface of vacuum cup 38 always remains horizontal irrespective of the rotational position of arms 34 and 35.

A shaft 190 is pivotally connected to a piston actuator 192 of an air cylinder 194 mounted to support plate 36. Activation of cylinder 194 into the position shown in FIG. 11 rotates the vacuum cup 38 into position to grasp the carton for erecting same. A bottom vacuum hold down bead 199 is secured to the apparatus to engage the bottom of the carton whereas vaccum cup 38 engages the top of the carton to open same. It should be appreciated that the support plate 36 includes mounting slots 196 in a manner similar to the slots 182 of the tucker arm enabling rapid replacement adjustments or interchanging of the erector means with similar or other machines.

FIG. 11 illustrates the ram stage 58 comprising a ram plate 198 slidably mounted by rods 200 in bearings 202 secured to the frame of the machine. Air cylinder ram 62 moves the ram plate into engagement with stationary plate 60 to seal the bottom major and minor flap of the carton.

Figure 6:
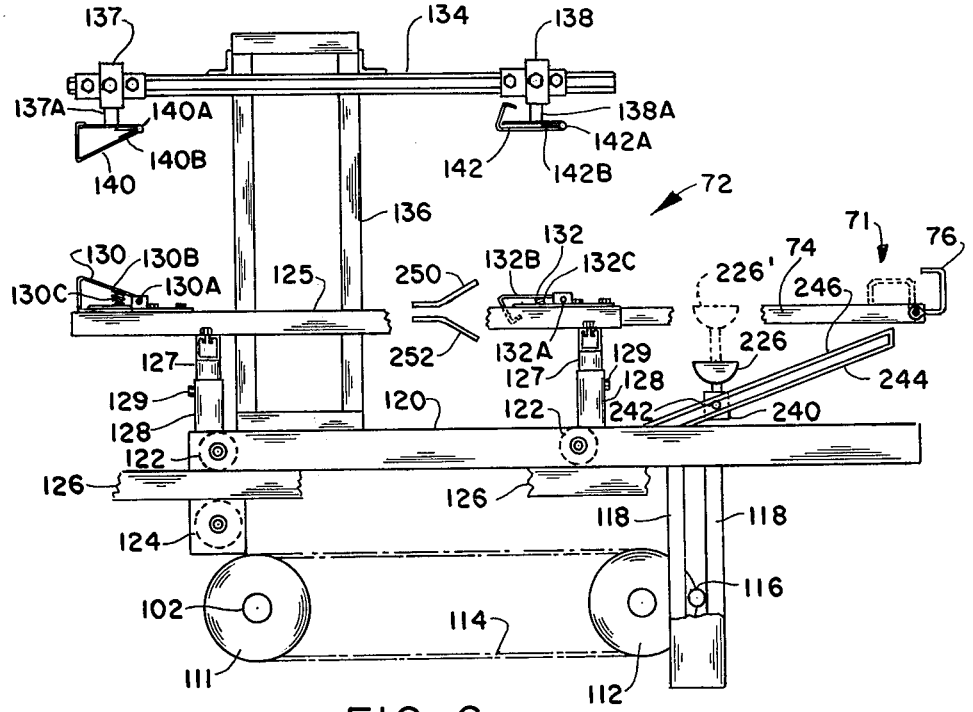
FIG. 6 is an enlarged side elevational view of a second track movement means.
Figure 7:
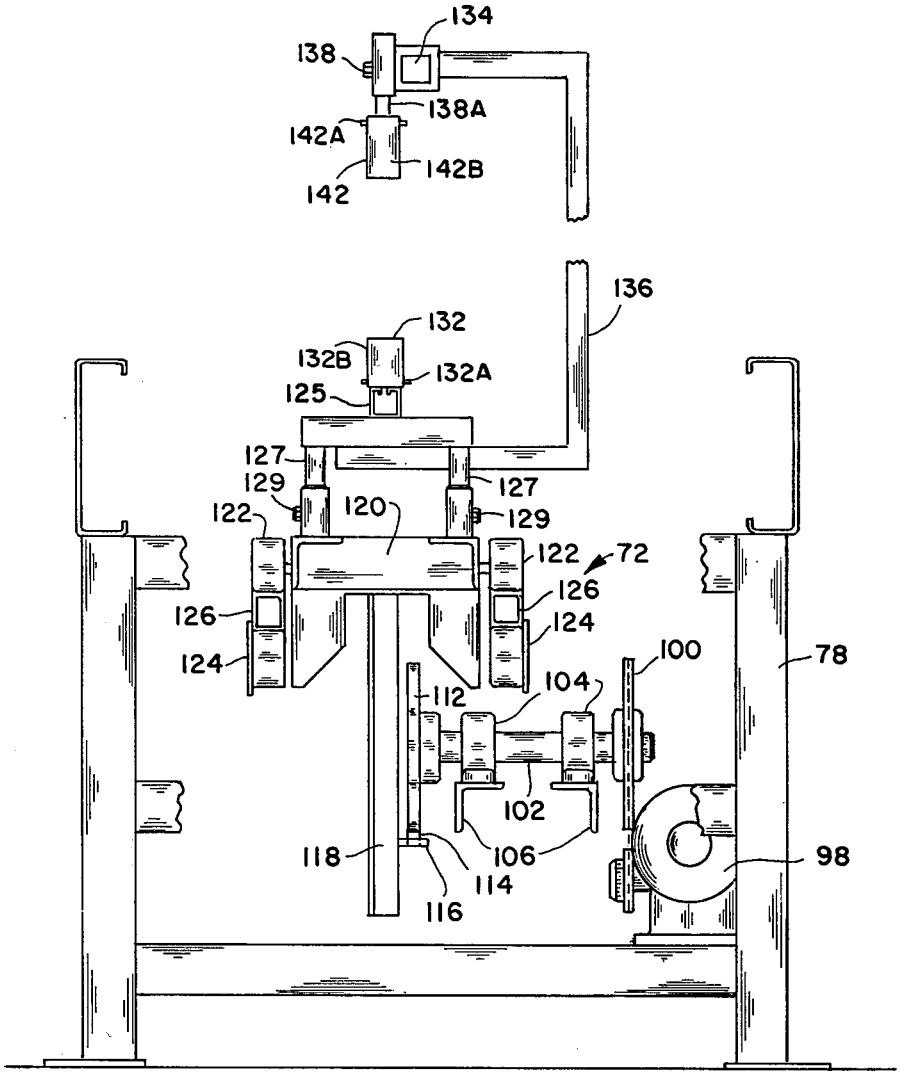
FIG. 7 is an end view of FIG. 6.

The top flap folder means 31 shown most clearly in FIGS. 13 and 14 compries a support 220 secured relative to frame 78 having an air cylinder 222 with a piston thereof 224 established from moving arms 228 and 230 through a pivot 232. FIG. 13 shows the air cylinder 222 in a deactivated position with the terminal ends 228A and 230A disposed between the flaps 18A and 20A and the flaps 20B and 18B. A vacuum separator head 226 separates the major and minor flaps enabling the terminal ends 228A and 230A to be interposed therebetween. The movement of the vacuum head 226 is more fully shown in FIG. 6. The separator head 226 is slidably mounted on a block 240 having a roller 242 received between parallel guides 244 and 246. Parallel guides 244 and 246 are secured to slidable support 120. Movement to the extreme right position as shown in FIG. 6 causes the vacuum head separator 226 to be in the lower position as shown. Movement to the extreme left in FIG. 6 of the slidable support 120 results in the vacuum head being raised to the phantom position 226' to grasp the bottom flap 20B of the carton 20 as shown in FIG. 13. Movement again to the right in FIG. 6 results in the vacuum head being displaced downwardly to separate the upper and lower flaps. Activation of air cylinder 222 as shown in FIG. 14 fold the major and minor flaps back into the position as shown in FIGS. 2B and 14 to enable the carton to be subsequently erected by the erector arm 32. Upper and lower guides 250 and 252 shown in FIG. 6 further fold the flaps upon movement of the carton 12 along track 21.

The foregoing has disclosed a unique machine incorporating various improved stages which results in a more economical and more reliable machine. It should be understood that the various stages set forth herein may be incorporated on other machines of different designs or may be interchanged on the same machine. These modifications are to be construed as being incorporated within the instant invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. An apparatus for erecting folded cartons having top and bottom flaps, comprising in combination:

a carton track having a first and a second end;

carton magazine means disposed on said first end of said track;

first track movement means for moving a folded carton on said track from said carton magazine means to a first position;

top flap folding means interposed in said first track for folding the top flaps of the carton;

second track movement means disposed adjacent said first track for moving the carton from said first position to said second end of said track;

carton erecting means disposed at a second position on said second track for erecting the folded carton;

bottom flap folding means disposed at a third position on said second track for folding the bottom flaps of the carton;

sealing means disposed at a fourth position on said second track for sealing the bottom flaps of the erected carton into a rigid structure;

one of said first and second track movement means includes a first and a second rotatable member spaced relative to one another;

flexible means about said rotatable members and having a driving portion on said flexible means for generating a reciprocal movement of said driving portion relative to said track; and means cooperates with said driving portion for sequentially moving cartons along said track upon rotation of said rotatable members.

2. An apparatus as set forth in claim 1, wherein said first track movement means includes a pickup arm for moving the cartons along said track.

3. An apparatus as set forth in claim 1, wherein said driving portion comprises a projection extending from said flexible means.

4. An apparatus as set forth in claim 3, wherein said one of said track movement means further comprises plural parallel finger means for receiving said projection therebetween for generating said reciprocal movement from the movement of said projection.

5. An apparatus as set forth in claim 4, wherein one of said track movement means includes a substantially C-shaped member slidably mounted relative to said carton track for simultaneously engaging the top and bottom of an erected carton.

6. An apparatus as set forth in claim 5, wherein one of said track movement means further comprises pivotably driving surfaces for engaging the carton upon forward movement of said track movement means and for disengaging the carton upon backward movement of said track movement means.

7. An apparatus as set forth in claim 1, wherein one of said track movement said means includes a first and a second sprocket means mounted on a rotatable shaft;

a first chain interconnecting said first and second sprocket means;

a projection extending from said chain; and plural parallel finger means for receiving said projection therebetween for generating said reciprocal movement from the movement of said projection.

8. An apparatus as set forth in claim 1, wherein said erecting means includes a mounting plate having a plurality of slot apertures for positioning said carton erecting means relative to said apparatus; and air cylinder means secured to said mounting plate enabling adjustment of said carton erecting means relative to said apparatus.

9. An apparatus as set forth in claim 1, wherein said bottom flap folding means comprises a tucker arm pivotably mounted relative to a mounting plate;

air cylinder means secured to said mounting plate for rotating said tucker arm; and adjustment mounting means for mounting said mounting plate relative to the apparatus enabling replacement or adjustment thereby.

10. An apparatus as set forth in claim 1, wherein said sealer means is adjustably mounted relative to said apparatus for enabling adjustment or replacement thereby.

11. An apparatus as set forth in claim 1, wherein said bottom flap folding means comprises first and second flap folders for respectively folding minor and major flaps of the carton.

12. An apparatus as set forth in claim 1, wherein said top flap folder means comprises plural separator arms;

means for positioning said plural separator arms between the top flaps of the carton; and means for separating said plural separator arms for folding the top flap thereby.

13. An apparatus as set forth in claim 12, including a separator vaccum head disposed in said first position on said track; and means for moving said separator vacuum head in a vertical direction enabling said vacuum head to grasp the underside of the carton to separate the top flaps enabling said plural separator arms to be disposed therebetween.

* * * * *

UNITED STATES PATENT AND TRADEMARK OFFICE

CERTIFICATE OF CORRECTION

PATENT NO. : 4,275,644

DATED : June 30, 1981

INVENTOR(S) : Edward L. Moss

It is certified that error appears in the above—identified patent and that said Letters Patent is hereby corrected as shown below:

Column 1, line 10, "apparatuses" should read -- apparati --.

Column 1, line 24, "large" should read -- larger --.

Column 1, line 27, "anotner" should read -- another --.

Column 5, line 27, "30" should read -- 30A --.

Column 5, line 54, delete "second".

Column 5, line 60 delete "second".

Column 7, line 14, "positions" should read -- position --.

Column 7, line 27, "bead" should read -- head --.

Column 7, line 42, "compries" should read -- comprises --.

Signed and Sealed this

*Third* Day of *November 1981*

[SEAL]

*Attest:*

GERALD J. MOSSINGHOFF

*Attesting Officer* *Commissioner of Patents and Trademarks*